US007439675B2

(12) United States Patent
Aoki et al.

(10) Patent No.: US 7,439,675 B2
(45) Date of Patent: Oct. 21, 2008

(54) PLASMA DISPLAY PANEL HAVING A MAGNESIUM OXIDE PROTECTIVE FILM AND METHOD FOR PRODUCING SAME

(75) Inventors: Masaki Aoki, Mino (JP); Yumi Kondo, Osaka (JP); Kazuhiko Sugimoto, Kyoto (JP); Hiroshi Setoguchi, Takatsuki (JP); Junichi Hibino, Kyoto (JP); Yoshinori Tanaka, Hirakata (JP); Teppei Hosokawa, Shijonawate (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 126 days.

(21) Appl. No.: 10/518,697

(22) PCT Filed: Apr. 21, 2004

(86) PCT No.: PCT/JP2004/005686

§ 371 (c)(1),
(2), (4) Date: Dec. 21, 2004

(87) PCT Pub. No.: WO2004/095496

PCT Pub. Date: Nov. 4, 2004

(65) Prior Publication Data

US 2005/0212429 A1 Sep. 29, 2005

(30) Foreign Application Priority Data

Apr. 22, 2003 (JP) ..... 2003-116876

(51) Int. Cl.
*H01J 17/49* (2006.01)

(52) U.S. Cl. ..... 313/587; 313/582; 445/23

(58) Field of Classification Search ..... 445/23–25; 313/582–587
See application file for complete search history.

(56) References Cited

FOREIGN PATENT DOCUMENTS

| | | | |
|---|---|---|---|
| EP | 1 237 175 | A2 | 9/2002 |
| EP | 1 388 878 | A1 | 2/2004 |
| EP | 1 408 528 | A2 | 4/2004 |
| JP | 56-61739 | | 5/1981 |
| JP | 8-236028 | | 9/1996 |
| JP | 11-003665 | | 1/1999 |
| JP | 11-095234 | | 4/1999 |
| JP | 11-339665 | | 12/1999 |
| JP | 2000-057939 | | 2/2000 |
| JP | 2000-76989 | | 3/2000 |
| JP | 2000294153 | * | 10/2000 |
| JP | 2002-260535 | | 9/2002 |
| JP | 2004-047193 | | 2/2004 |

(Continued)

OTHER PUBLICATIONS

Kim, Rakhwan, "Influence of densification of the protective layer on the discharge voltage in AC plasma display panel", Vacuum, vol. 61, 2001, pp. 37-43.

*Primary Examiner*—Joseph L Williams
(74) *Attorney, Agent, or Firm*—Steptoe & Johnson LLP

(57) ABSTRACT

The present invention provides a plasma display panel that suppresses discharge sustain voltage, and reduces brightness degradation of a phosphor. In the plasma display panel, as protective film (14) made of magnesium oxide (MgO) formed on dielectric glass layer (13), protective film (14) made of magnesium oxide (MgO) with oxide added with an electronegativity of 1.4 or higher, is formed to suppress impure gas adsorption by protective film (14), stabilizes discharge sustain voltage, and reduces brightness degradation.

4 Claims, 4 Drawing Sheets

FOREIGN PATENT DOCUMENTS

| | | |
|---|---|---|
| JP | 2004-131785 | 4/2004 |
| KR | 2001-0011996 A | 2/2001 |
| KR | 2001-046093 A | 6/2001 |

* cited by examiner

PLASMA DISPLAY PANEL HAVING A MAGNESIUM OXIDE PROTECTIVE FILM AND METHOD FOR PRODUCING SAME

This application is a U.S. National Phase application of PCT International application PCT/JP2004/005686.

TECHNICAL FIELD

The present invention relates to a plasma display panel to be used for a display device and the like, and to a method for producing the plasma display panel, especially to a highly efficient magnesium oxide (MgO) protective film for the panel.

BACKGROUND ART

In recent years, for color display devices used for image display such as in computers and television sets, a plasma display device using a plasma display panel (hereinafter, abbreviated as "PDP" or "panel") receives attention as a large-size, thin, and lightweight color display device.

An AC surface-discharge-type PDP, which is a representative AC type, has a front panel formed with a glass substrate where scan electrodes and sustain electrodes are arranged for surface discharge; and a back panel made of a glass substrate formed with data electrodes being arranged. The front and back panels, arranged in parallel, are facing each other so that both scan and sustain electrodes, and data electrodes form a matrix, and also their gaps form discharge spaces. Its outer edge is sealed with a sealant such as glass frit. Further, discharge cells partitioned by barrier ribs are provided between the substrates, and phosphor layers are formed in the cell spaces between the barrier ribs. A PDP with such a makeup displays color images by exciting phosphors in red (R), green (G), and blue (B), with ultraviolet light generated by gas discharge for light emission.

Such an AC surface-discharge-type PDP is provided with a dielectric layer covering the electrodes on the front panel, and also with a protective film made of magnesium oxide (MgO) for protecting the dielectric layer. A method of modifying the surface of a protective film, requiring a high electron emission performance and anti-sputtering property, is disclosed for example in, Japanese Patent Unexamined Publication No. H08-236028, No. 2000-57939, and No. 20007-6989.

In such an AC surface-discharge-type PDP, magnesium oxide (MgO) has the following problems as a protective film. That is, for magnesium oxide (MgO), the electronegativity of magnesium is low, and thus its crystal has a strong ionicity, prone to have positive electrification. Usually, magnesium oxide (MgO) has an interface with a large number of asperities and crystal defects, and positive charge of Mg ion is exposed all over the defects. Therefore, $H_2O$, $CO_2$, or a hydrocarbon gas (mostly, a resolvent from organic binders) generated in various processes of PDP manufacturing is adsorbed around the defects, causing discharge to be unstable and the discharge voltage to rise. In addition, the $H_2O$, $CO_2$, or hydrocarbon gas adsorbed to magnesium oxide (MgO) are emitted into the panel during discharge after the panel is produced, to be adsorbed to the phosphor surface. This causes oxidative and reducing reactions to non-crystallize the surface of the phosphor particles, resulting in a low brightness.

The present invention aims at providing a PDP with a stable discharge characteristic and low brightness degradation, by implementing a protective film made of magnesium oxide (MgO) with a low gas adsorption.

SUMMARY OF THE INVENTION

In order to achieve the above-mentioned purpose, a PDP according to the present invention includes a front panel and a back panel, where the front panel includes a first electrode on a first substrate; a dielectric glass layer covering the first electrode; and a protective film provided on the dielectric glass layer, made of magnesium oxide (MgO) with oxide added including an element with an electronegativity of 1.4 or higher, and the back panel includes at least a second electrode on a second substrate; barrier ribs; and a phosphor layer. The protective film and the phosphor layer are arranged facing each other, and a discharge space partitioned with barrier ribs is formed between the front and back panels.

Such a makeup allows positive electrification of a protective film to be weakened owing to oxide with an electronegativity higher than that of magnesium oxide (MgO), and thus reduces the amount of $H_2O$ and $CH_x$ to be adsorbed to the protective film, implementing a PDP with a stable discharge characteristic and low brightness degradation.

DETAILED DESCRIPTION OF PREFERRED EMBODIMENT

A description is made for a PDP according to the present invention using the drawings.

Figure 1:
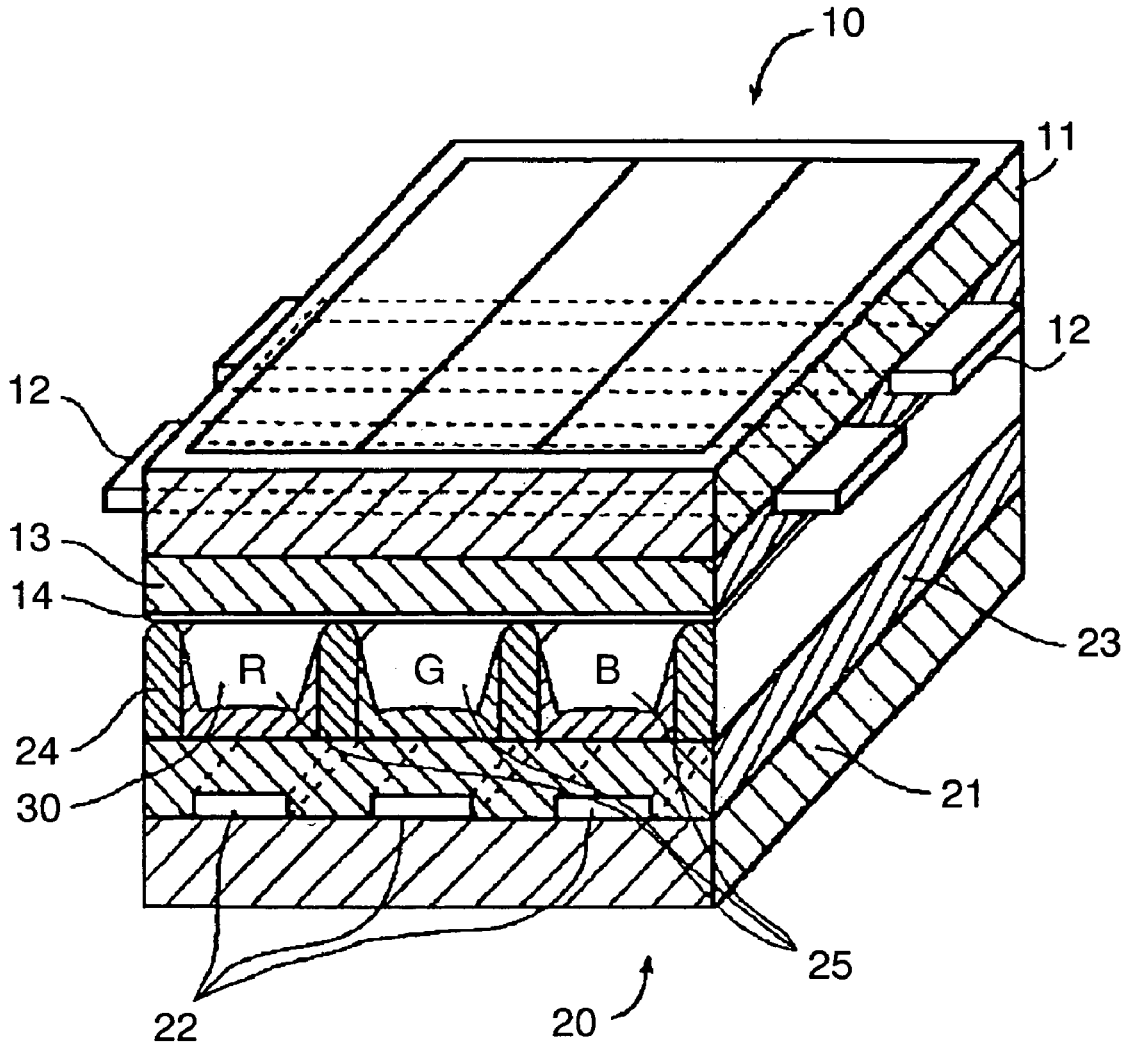
FIG. 1 is a perspective sectional view of a PDP according to an embodiment of the present invention.

FIG. 1 is a perspective sectional view of a PDP according to an embodiment of the present invention.

The PDP is provided, on front glass substrate 11, with discharge electrodes 12, which are a pair of first electrodes performing display scan and discharge sustain, and dielectric glass layer 13. Protective film 14 made of magnesium oxide (MgO) is further provided on dielectric glass layer 13 to form front panel 10. On rear glass substrate 21, address electrode 22, which is a second electrode, base dielectric glass layer 23, barrier rib 24, and phosphor layer 25 are provided to form back panel 20. Front panel 10 and back panel 20 are bonded together to form discharge space 30 therebetween to encapsulate a exhaust gas therein.

Front panel 10 is produced as described hereinafter. That is, after film-forming a transparent electrode on front glass substrate 11 with sputtering or the like, make a pattern. Then, apply a silver electrode paste with screen printing or the like to form discharge electrode 12. Next, apply a dielectric glass paste made of 75% lead oxide (PbO), 15% boron oxide ($B_2O_3$), 10% silicon oxide ($SiO_2$), all by weight, for example, with screen printing or the like, so as to cover discharge electrode 12 to form dielectric glass layer 13. Here, the pastes applied with screen printing become solidified through baking process. Next, form protective film 14 made of magnesium oxide (MgO) with oxide added including an element with an electronegativity of 1.4 or higher, and negative charge, with plasma chemical vapor deposition (CVD), high-frequency sputtering, vacuum evaporation, ion-plating method, or the like, on dielectric glass layer 13.

Meanwhile, back panel 20 is produced as described hereinafter. That is, apply a silver electrode paste onto rear glass substrate 21 with screen printing to form address electrode 22. Then, apply a lead-based glass paste so as to cover address electrode 22 with screen printing or the like to form base dielectric glass layer 23. Next, apply an insulation material paste, and then make a pattern to form barrier ribs 24 with a predetermined pitch. Here, in the same way as in forming front panel 10, the pastes become solidified through baking process. Next, allocate red, green, and blue phosphors in the respective spaces flanked by barrier ribs 24 to form phosphor layer 25. For a phosphor in each color, one for a PDP can be generally used. Here, $(Y_xGd_{1-x})BO_3:Eu^{3+}$ is used for a red phosphor; $Zn_2SiO_4:Mn^{2+}$, for green; $BaMgAl_{10}O_{17}:Eu^{2+}$, for blue.

Next, bond together front panel 10 and back panel 20, both having been made in the above way, using sealing glass, so that discharge electrode 12 and address electrode 22 are orthogonal. Then, after exhausting discharge space 30 partitioned by barrier ribs 24 to a high vacuum ($8\times10^{-7}$ Torr), encapsulate an exhaust gas composed of a predetermined composition with a predetermined pressure to produce a PDP.

Here, a PDP according to this embodiment is formed so that the cell pitch is 0.2 mm or shorter, and the distance between discharge electrodes 12 is 0.1 mm or shorter, in order to be fit for a 40-inch-class HDTV. Barrier ribs 24 are arranged in a double cross, namely they are also provided between cells orthogonal to the direction of electrode 22, to improve brightness.

In addition, the composition of the discharge gas to be encapsulated is a conventionally used Ne—Xe base. The content of Xe is set to 10% or more by volume, and also the charged pressure is set in a range of 400 Torr to 760 Torr to raise the density of Xe, improving the emission brightness of the cell.

Figure 2:
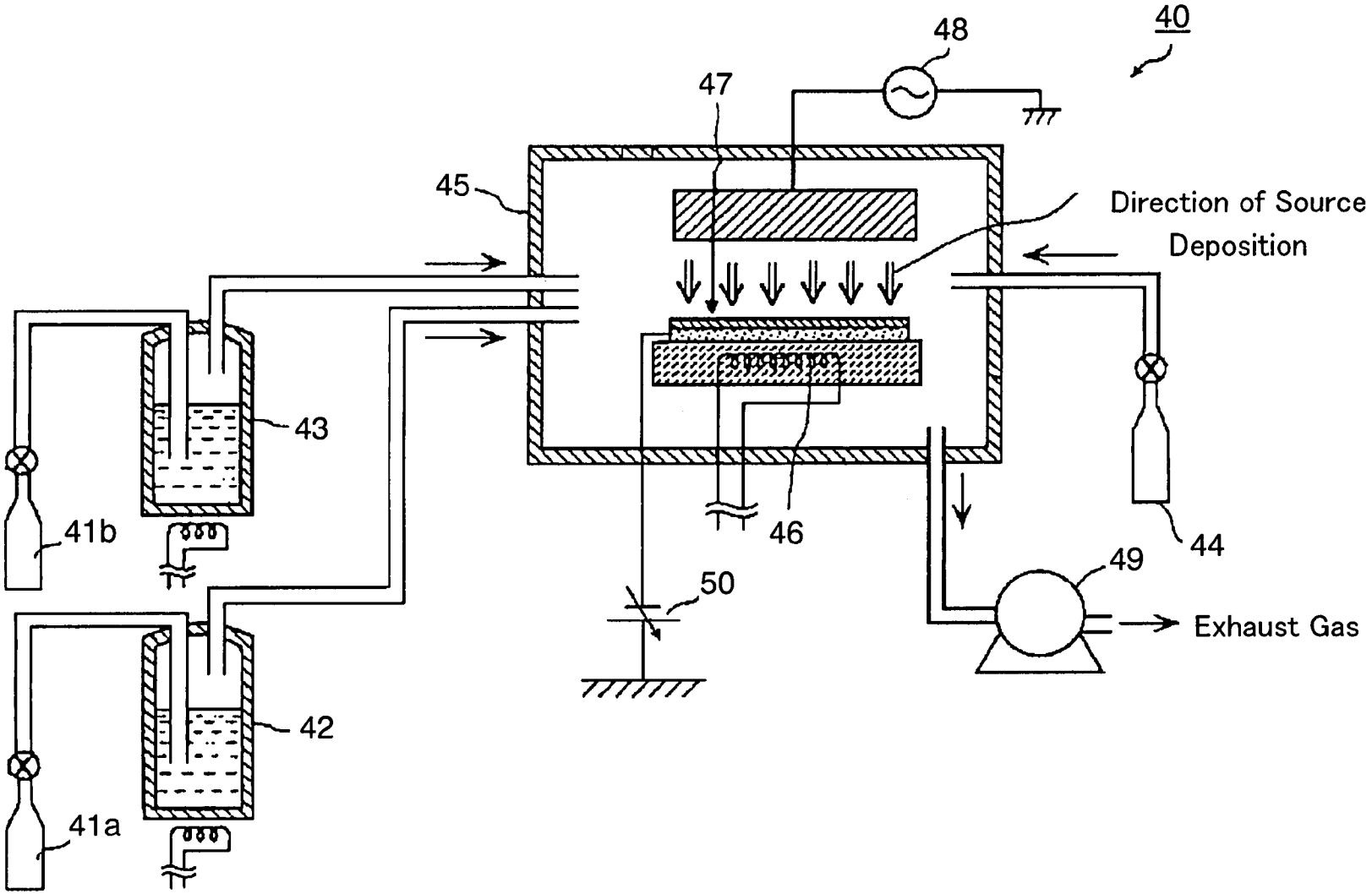
FIG. 2 is a schematic diagram of a plasma chemical vapor deposition (CVD) apparatus to be used when forming a protective film according to an embodiment of the present invention.

Next, a description is made for a method of forming a magnesium oxide (MgO) protective film. The first method is one by means of plasma CVD method. FIG. 2 is a schematic diagram of a plasma CVD apparatus to be used when forming a protective film.

Plasma CVD apparatus 40 is provided with heater 46 for heating glass substrate 47 composed of front glass substrate 11 forming discharge electrode 12 and dielectric glass layer 13 in plasma CVD apparatus main body 45. The inside of plasma CVD apparatus main body 45 can be decompressed with exhaust device 49. Plasma CVD apparatus main body 45 is further provided with high-frequency power supply 48 for generating plasma. In addition, power supply 50 is provided for biasing using glass substrate 47 as a negative electrode. In the outside, argon (Ar) cylinders 41*a* and 41*b* are provided, supplying plasma CVD apparatus main body 45 with an argon (Ar) gas as a carrier gas, through carburetors 42 and 43. Carburetor 42 stores magnesium oxide (MgO) and metal chelate, which is a raw material for oxide to be added, both heated. Blowing an argon (Ar) gas into carburetor 42 from argon (Ar) cylinder 41*a* causes the metal chelate to vaporize and to be sent to plasma CVD apparatus main body 45. Carburetor 43 stores magnesium oxide (MgO), and acetylacetone and cyclopentadienyl compound, which are raw materials for the additives, all heated. Blowing an argon (Ar) gas into carburetor 43 from argon (Ar) cylinder 41*b* causes the acetylacetone and cyclopentadienyl compound to vaporize and to be sent to plasma CVD apparatus main body 45. Oxygen ($O_2$) cylinder 44 supplies plasma CVD apparatus main body 45 with oxygen ($O_2$) as a reactant gas.

When performing plasma CVD with the above-mentioned plasma CVD apparatus 40, the heating temperature for glass substrate 47 by heater 46 is set in a constant temperature range of 250° C. to 380° C., and the inner pressure of the reactor is decompressed to 30 Pa to 300 Pa using exhaust apparatus 49. Activating high-frequency power supply 48 to apply a high-frequency electric field with 13.56 MHz, for example, generates plasma in plasma CVD apparatus main body 45. This causes extremely chemically active radical atoms to occur from the raw material gas sent into the reactor, to form protective film 14, with accumulating products due to a chemical reaction on the substrate.

Here, for metal chelate and a cyclopentadienyl compound supplied from carburetor 42 or 43, as a raw material of Mg, the followings can be used for example: magnesium dipivaloyl methane $[Mg(C_{11}H_{19}O_2)_2]$, magnesium acetylacetone $[Mg(C_5H_7O_2)_2]$, cyclopentadienyl magnesium $[Mg(C_5H_5)_2]$, and magnesium trifluoroacetylacetone $[Mg(C_5H_5F_3O_2)_2]$. As a raw material of element M (Ti, Zr, Ge, V, Nb, Ta, Sb, Cr, Mo, W, Sn, B, Si, Pb, or Mn) for adding oxide including an element with an electronegativity of 1.4 or higher, the followings can be used: dipivaloyl methane $[M(C_{11}H_{19}O_2)_n]$, acetylacetone $[M(C_5H_7O_2)_n]$, trifluoroacetylacetone $[M(C_5H_5F_3O_2)_n]$, or the like. When adding oxide to magnesium oxide (MgO) using such a raw material, mix Mg and a raw material of M with a molar ratio of 1:0.000005 to 0.005. Controlling the amount of oxide added is achieved by controlling the molar ratio of M and the temperature of the carburetor. Forming protective film 14 with plasma CVD method where a negative bias is applied to the substrate, using such a raw material, enables oxide to be added including an element with an electronegativity of 1.4 or higher in protective film 14 made of magnesium oxide (MgO).

The reason why the electronegativity of an element of oxide to be added is set to 1.4 or higher is that the electronegativity of the magnesium in the magnesium oxide (MgO) is 1.25, and a value larger than 1.25 increases the electronegativity of protective film 14 made of magnesium oxide (MgO). In addition, oxide including an element with an electronegativity of 1.4 or higher generally shows negative charge, and thus controlling the adding amount facilitates controlling the electrification of protective film 14.

Figure 3:
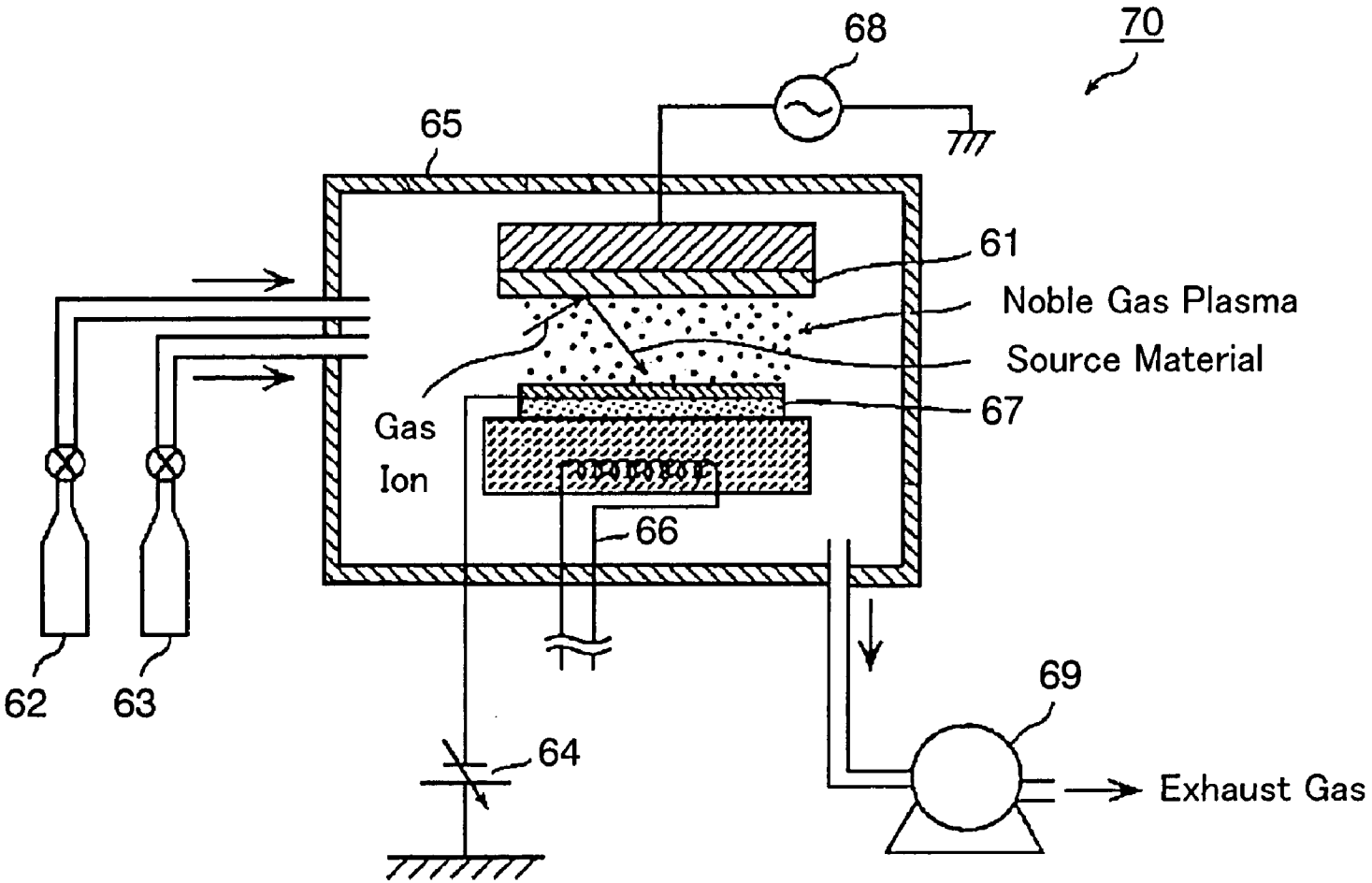
FIG. 3 is a schematic diagram of a high-frequency sputtering apparatus to be used when forming a protective film according to an embodiment of the present invention.

Next, a description is made for a method of forming protective film 14 with high-frequency sputtering. FIG. 3 is a schematic diagram of a high-frequency sputtering apparatus to be used when forming protective film 14.

Sputtering apparatus 70 is provided, in sputtering apparatus main body 65, with heater 66 for heating glass substrate 67 composed of front glass substrate 11 formed with discharge electrode 12 and dielectric glass layer 13. The inside of sputtering apparatus main body 65 can be decompressed with exhaust apparatus 69. Sputtering apparatus main body 65 is further equipped with high-frequency power supply 68 for generating plasma therein. Target 61 with oxide added by 0.0005% to 0.5% by mole, including magnesium oxide (MgO) and an element with an electronegativity of 1.4 or higher, is mounted on high-frequency power supply 68. In addition, power supply 64 for applying a negative bias to glass substrate 67 is provided. Argon (Ar) cylinder 62 supplies sputtering apparatus main body 65 with an argon (Ar) gas as a sputter gas, while oxygen ($O_2$) cylinder 63 supplies sputtering apparatus main body 65 with oxygen ($O_2$) as a reactant gas.

When sputtering using sputtering apparatus 70 with the above-mentioned makeup, place glass substrate 67 with dielectric glass layer 13 up, to heat glass substrate 67 up to 250° C. to 380° C. Then, decompress down to 0.1 Pa to 10 Pa using exhaust apparatus 69, with introducing argon (Ar) and oxygen ($O_2$) gases to sputtering apparatus main body 65. Next, activate high-frequency power supply 68 to form protective film 14 made of magnesium oxide (MgO), with generating plasma in sputtering apparatus main body 65. Here, if sputtering target 61 with applying a potential of −100 V to −150 V to glass substrate 67 using power supply 64 to form protective film 14, the film-forming speed and deposition characteristic are further improved. Controlling the amount of oxide including an element with a high electronegativity, added into the protective film made of magnesium oxide (MgO), can be performed by controlling the amount of oxide added into target 61, and a high-frequency power.

Figure 4:
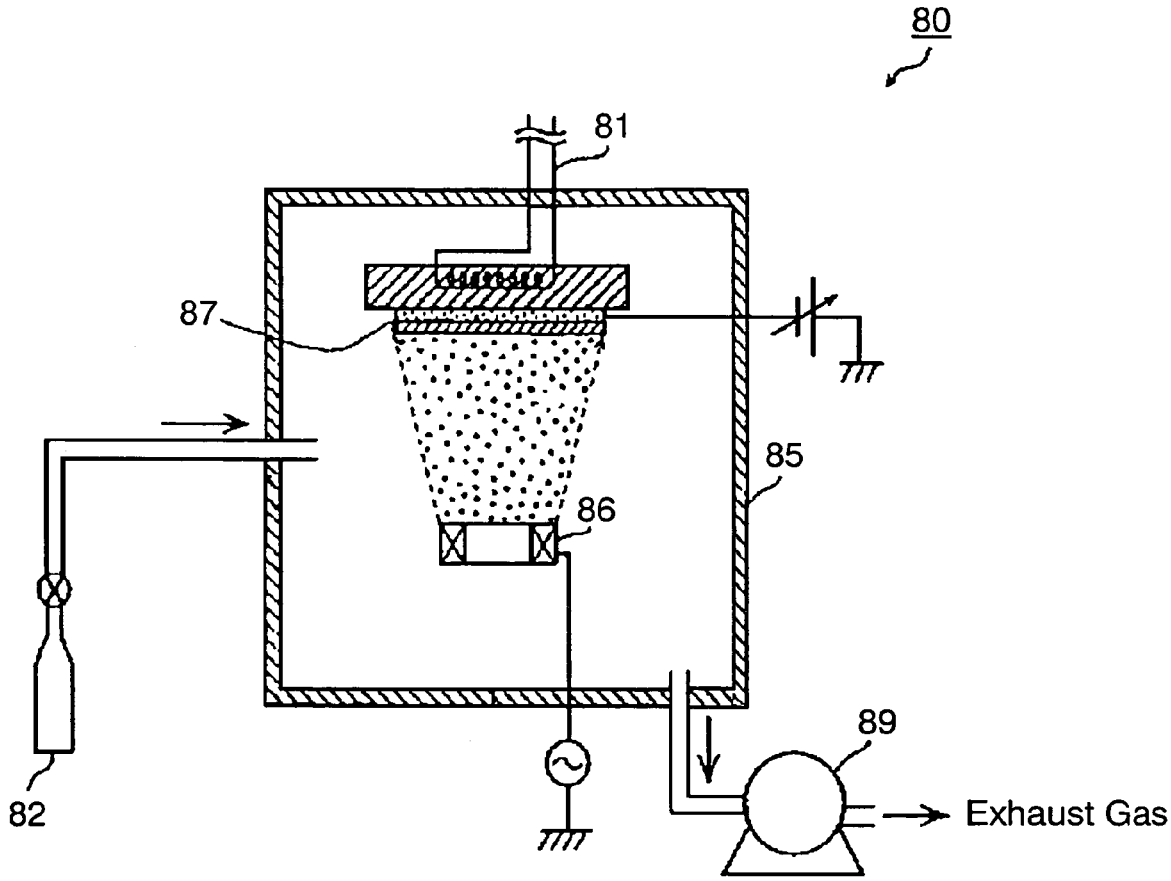
FIG. 4 is a schematic diagram of a vacuum deposition apparatus to be used when forming a protective film according to an embodiment of the present invention.

Next, a description is made for a method of forming protective film 14 with vacuum evaporation. FIG. 4 is a schematic diagram of a vacuum deposition apparatus to be used when forming protective film 14.

Vacuum deposition apparatus 80 is provided, in vacuum deposition apparatus main body 85, with heater 81 for heating glass substrate 87 composed of front glass substrate 11 formed with discharge electrode 12 and dielectric glass layer 13. Further, the inside of vacuum deposition apparatus main body 85 can be decompressed with exhaust apparatus 89. In addition, vaporization source 86 is provided for vaporizing magnesium oxide (MgO) and oxide for additives, including electron beams and a hollow cathode. Oxygen ($O_2$) cylinder 82 supplies the inside of vacuum deposition apparatus main body 85 with an oxygen ($O_2$) gas for a reactant gas.

When performing deposition using vacuum deposition apparatus 80 with the above-mentioned makeup, place glass substrate 87 with dielectric glass layer 13 down, to decompress down to 0.01 Pa to 1.0 Pa using exhaust apparatus 89, with introducing an oxygen ($O_2$) gas into vacuum deposition apparatus main body 85. Further, vaporization source 86 for electron beams and a hollow cathode vaporizes magnesium oxide (MgO) with additives of 0.0005% to 0.5% by mole added to form protective film 14.

The magnesium oxide (MgO) protective film formed with the conventional vacuum evaporation method (EB method), uses magnesium oxide (MgO) with a purity of approximately 99.99%. However, magnesium oxide (MgO) itself is a material with a low electronegativity and a large ionicity. Therefore, $Mg^+$ ion on its surface is in an unstable, high-energy state, locally exposing electrification, and adsorbs an ionic material such as a hydroxyl group ($OH^-$ group) to be stabilized. In addition, the result of cathode luminescence measurement for film-formed magnesium oxide (MgO) indicates that a large number of luminescence peaks due to oxygen defects are observed, and also these defects are adsorption sites for $H_2O$, $CO_2$, or a hydrocarbon gas.

In order to decrease the number of these adsorption sites due to the local positive electrification, it is required to lower the strong ionic bond of magnesium oxide (MgO) with a low electronegativity. In order for this, add oxide including an element with a high electronegativity and a strong covalency, namely with a low ionic binding, especially an element with an electronegativity of 1.4 or higher, and having negative electrification, to reduce the strong ionic boning. In other words, when M-O bond, which is covalency different from Mg—O bond, and strong in ionic bond, is added to a part of magnesium oxide (MgO) crystal, the adsorption characteristic of $H_2O$, $CO_2$, or $CH_x$ changes. This is presumably because the defects of magnesium oxide (MgO) are controlled so that the number of gas adsorption sites are reduced.

Reducing the amount of various gases adsorbed into magnesium oxide (MgO) in this way enables stabilization of the discharge sustain voltage, and solves the problem of brightness degradation due to oxidization and reducing reactions of the phosphor caused by impure gases (e.g. $H_2O$, $CO_2$, $CH_x$, etc.).

Oxide including an element with an electronegativity of 1.4 to 2.55, has been proved to be effective at reducing gas adsorption, stabilization of the discharge sustain voltage, and suppression of brightness degradation.

EMBODIMENT

Hereinafter, a description is made for an embodiment according to the evaluation result of the sample produced with the above-mentioned method.

Table 1 shows the characteristic of a PDP for a case where various oxides including an element with a high electronegativity are added to the magnesium oxide (MgO) protective film, with its film-forming method changed. The PDP of sample No. 1 through No. 6 shown in table 1 has a magnesium oxide (MgO) protective film with an oxide added of an electronegativity of 1.4 or higher, made with the CVD method based on the above-mentioned embodiment. For the cell size of the PDP, according to a display for a 42-inch HDTV, the height of barrier rib 24 is set to 0.12 mm, and the clearance (cell pitch) between barrier ribs 24 is set to 0.15 mm, the structure of the barrier ribs is double-cross, where barrier ribs 24 are arranged in each cell, and the distance between discharge electrodes 12 is set to 0.06 mm. In addition, lead-based dielectric glass layer 13 is formed in the following way. That is, apply a composition that is a mixture of 65% lead oxide (PbO), 25% boron oxide ($B_2O_3$), 10% silicon oxide ($SiO_2$), all by weight, and an organic binder (alpha-terpineol with 10% of ethycellulose dissoluted), with screen printing, and then bake it at 520° C. for 10 minutes, where its film thickness is 30 μm.

The pressure inside the reactive box in the plasma CVD apparatus is set to 30 Pa to 300 Pa, the flow rate of an argon (Ar) gas is set 1 liter/min.; and that of an oxygen ($O_2$), 0.5 liter/min., both passed for 1 minute. A high-frequency electric field is applied at 300 W to 500 W for 1 minute, and the film-forming speed is adjusted to 0.9 μm/min. The thickness of the magnesium oxide (MgO) protective film with oxide added including an element with an electronegativity of 1.4 or higher is set to 0.9 μm, the amount of oxide added is set to 0.5% or less by mole (5,000 ppm or less), desirably in the range of 0.005% to 0.5% by mole. The amount of oxide to be actually added does not influence the result as long as it is within the above-mentioned range, indicating an obvious effect. Still, table 1 also shows electronegativity and its charge tendency of the element added to the oxide.

Samples No. 7 through No. 9 are protective films made with high-frequency sputtering, while samples No. 10 through No. 14 are made with vacuum evaporation method. Samples No. 15 and No. 16 are conventional magnesium oxide (MgO) protective films, without oxide added including an element with a high electronegativity, film-formed with vacuum evaporation method and high-frequency sputtering, for comparative examples.

Table 1 shows, as the evaluation result for the PDP, the change rates of the discharge sustain voltage and the brightness. The discharge sustain voltage, largely influenced by the performance of the magnesium oxide (MgO) protective film covering discharge electrodes, is a voltage at which discharge is about to extinguish when the voltage is lowered after discharge of PDP started. The brightness corresponds to one of the whole panel, gained when set to the white color with a determined color temperature under a certain drive condition. In other words, it is the brightness of the whole-surface white display, rate-controlled by a phosphor with the most brightness degradation out of primary-color phosphors for representing a white color. The brightness is measured when driven at a frequency of 200 kHz. The change rates of discharge sustain voltage and brightness are obtained in the following way. That is, apply discharge sustain pulses with a voltage of 175 V and a frequency of 200 kHz, to the PDP for 1,000 hours continuously, measure the change in discharge sustain voltage and brightness before and after the application, and obtain the respective change rates with the formula: (the value after application−the value before application)/the value before application*100.

TABLE 1

| Sample No. | Kind of oxide material added to MgO | Electronegativity and charge tendency of oxide added to MgO | Method of film-forming MgO | Change rate of discharge sustain voltage (%) Initially 175 V, 200 kHz after 1,000 hours | Change rate of brightness (complete white display) (%) Initially 175 V, 200 kHz after 1,000 hours |
|---|---|---|---|---|---|
| 1 | $Nb_2O_5$ | 1.6 negative charge | CVD method | 1.9 | −5.2 |
| 2 | $TiO_2$ | 1.5 negative charge | (same as the above) | 2.1 | −5.5 |
| 3 | $ZrO_2$ | 1.4 negative charge | (same as the above) | 2.5 | −6.1 |
| 4 | $Ta_2O_5$ | 1.5 negative charge | (same as the above) | 2.2 | −5.5 |
| 5 | $V_2O_5$ | 1.7 negative charge | (same as the above) | 1.8 | −5.1 |
| 6 | $SnO_2$ | 1.9 negative charge | (same as the above) | 1.6 | −4.9 |
| 7 | $Sb_2O_3$ | 2 negative charge | Sputtering | 1.5 | −4.8 |
| 8 | $GeO_2$ | 1.8 negative charge | (same as the above) | 1.8 | −5.1 |
| 9 | $B_2O_3$ | 2 negative charge | (same as the above) | 1.5 | −4.5 |
| 10 | $MoO_2$ | 2.2 negative charge | VE method | 1.4 | −4.2 |
| 11 | $WO_2$ | 2.2 negative charge | (same as the above) | 1.4 | −4.3 |
| 12 | $Cr_2O_3$ | 1.9 negative charge | (same as the above) | 1.6 | −4.9 |
| 13 | $SiO_2$ | 1.6 negative charge | (same as the above) | 1.9 | −5.2 |
| 14 | PbO | 2.3 negative charge | (same as the above) | 1.5 | −4.5 |
| 15* | Not added | 1.2 positive charge | (same as the above) | 10.5 | −13.1 |
| 16* | Not added | 1.2 positive charge | Sputtering | 10.1 | −13.2 |

*Sample numbers 15 and 16 are comparative examples.

Table 1 indicates that in the PDPs of samples No. 1 through No. 14 with oxide added according to the present invention, their change rates of discharge sustain voltage after 1,000-hour emitting are only 1% to 2%, while in the PDPs of samples No. 15* and No. 16* with conventional magnesium oxide (MgO) protective films, the discharge sustain voltage rises by around 10% due to adsorption contamination on the film surface. In addition, table 1 indicates that the change rate of brightness after 1,000-hour emission of the panel deteriorates by around 13% in samples No. 15 and No. 16, while in the PDPs of samples No. 1 through No. 14 with oxide added, the deterioration is suppressed by −4% to −6%. This supports that impure gas adsorption by magnesium oxide (MgO) in the panel has been decreased in the PDPs of samples No. 1 through No. 14.

INDUSTRIAL APPLICABILITY

The present invention, in which a magnesium oxide (MgO) protective film with oxide added including an element with an electronegativity of 1.4 or higher, for a magnesium oxide (MgO) protective film covering discharge electrodes in the respective light-emitting cells, can provide a PDP that solves the problem of impure gas adsorption by the protective film, suppresses the rise of discharge sustain voltage, and significantly reduces brightness degradation.

The invention claimed is:

1. A plasma display panel comprising:

a front panel comprising:

a first substrate;

a first electrode on the first substrate;

a dielectric glass layer covering the first electrode; and a protective film on the dielectric glass layer, the protective film comprising magnesium oxide (MgO) and an additional oxide, said additional oxide comprising a strong-covalent and low-ionic binding element with an electronegativity of 1.4 or higher and having a negative charge including at least one of germanium oxide ($GeO_2$) and lead oxide (PbO); and a back panel on a second substrate comprising:

at least a second electrode;

a barrier rib; and a phosphor layer, wherein the protective film and the phosphor layer are arranged facing each other, and form a discharge space partitioned with a barrier rib between the front panel and the back panel.

2. The plasma display panel of claim 1, wherein the second electrode is positioned orthogonally to the first electrode.

3. A method for producing a plasma display panel including:

forming a first electrode on a first substrate;

forming a dielectric glass layer to cover the first electrode;

forming a protective film to cover the dielectric glass layer, the protective film comprising magnesium oxide (MgO) and an additional oxide, said additional oxide comprising a strong-covalent and low-ionic binding element with an electronegativity of 1.4 or higher and having a negative charge including at least one of germanium oxide ($GeO_2$) and lead oxide (PbO), wherein the process of forming the protective film is selected from the group consisting of sputtering, vacuum evaporation, and ion plating.

4. The method of claim 3, further comprising forming a second electrode on a second substrate, wherein the first electrode and the second electrode are arranged orthogonally to each other.

* * * * *